US009291439B2

(12) United States Patent
Murray et al.

(10) Patent No.: US 9,291,439 B2
(45) Date of Patent: Mar. 22, 2016

(54) PROJECTILE

(75) Inventors: Chris Murray, Bronte (AU); Steven Richard Courtley, Randwick (AU); Ron Gilbert, Grandview, TN (US); Craig Brown, Dulwich Hill (AU)

(73) Assignee: APPLIED EXPLOSIVES TECHNOLOGY PTY LIMITED, Moore Park NSW (AU)

( * ) Notice: Subject to any disclaimer, the term of this patent is extended or adjusted under 35 U.S.C. 154(b) by 336 days.

(21) Appl. No.: 13/537,931

(22) Filed: Jun. 29, 2012

(65) Prior Publication Data

US 2013/0002003 A1 Jan. 3, 2013

(30) Foreign Application Priority Data

Jun. 29, 2011 (AU) ..... 2011203164

(51) Int. Cl.

| | |
|---|---|
| ***F42D 3/04*** | (2006.01) |
| ***F42B 3/08*** | (2006.01) |
| ***F42B 12/34*** | (2006.01) |
| ***F42B 12/10*** | (2006.01) |
| ***F42B 12/20*** | (2006.01) |
| ***F42B 3/087*** | (2006.01) |

(52) U.S. Cl.

CPC ... *F42D 3/04* (2013.01); *F42B 3/08* (2013.01); *F42B 3/087* (2013.01); *F42B 12/10* (2013.01); *F42B 12/20* (2013.01); *F42B 12/34* (2013.01)

(58) Field of Classification Search

CPC ..... F42B 3/00; F42B 3/08; F42B 3/087; F42B 12/20; F42B 12/34; F42B 12/72; F42B 12/745; F42B 12/76; F42B 12/02; F42B 12/04; F42B 12/10; F42B 12/18; F42B 12/201; F42B 12/204; F42D 3/04; F42D 1/00; F42D 1/04; F42D 3/02; F42D 3/06

USPC ..... 102/301, 305, 314, 324, 331, 332, 473, 102/489, 499; 299/13

See application file for complete search history.

(56) References Cited

U.S. PATENT DOCUMENTS

| | | | | |
|---|---|---|---|---|
| 3,129,665 A * | 4/1964 | Evans, Jr. | F42B 12/10 102/476 |
| 3,472,166 A * | 10/1969 | Dowling | 102/318 |
| 3,645,205 A * | 2/1972 | Dowling | 102/318 |
| 6,457,416 B1 | 10/2002 | Micke | |
| 7,047,886 B2 * | 5/2006 | Micke et al. | 102/473 |

* cited by examiner

*Primary Examiner* — James S Bergin
(74) *Attorney, Agent, or Firm* — Ladas & Parry LLP

(57) ABSTRACT

A rock-fracturing mining explosive element; said explosive element subjected to an initial spreading against a target surface on impact of said explosive element with said target surface; said explosive element so constructed as to control the rate of spreading and compression against said surface prior to detonation.

16 Claims, 8 Drawing Sheets

PROJECTILE

The present invention relates to mining and, more particularly, to rock-fracturing explosive devices.

BACKGROUND

It is known to use explosive projectiles in a mining operation in which a charge, typically a cylindrical, cast pentolite or hexolite mass, housed in a cupped, finned, baseplated receptacle equipped with an impact fuse and detonator, (as described for example in U.S. Pat. No. 6,457,416), is fired against a rock face with the charge exploding on impact with the rock surface.

Typically such known projectiles virtually instantly begin to crush and pulverise on impact, with the pulverised, crushed cast explosive instantly dispersing as an extremely fine, fluid powder, in a radial, suspended fan propagating away from the impact site at very high speed. This phenomenon causes detonation to be concentrated at a relatively small quasi-cylindrical area at the point of impact. This has the effect of dissipating at least a portion of the blast wave away from the rock surface, rendering the charge less than optimally effective.

It is an object of the present invention to address or at least ameliorate some of the above disadvantages.

Notes

The term "comprising" (and grammatical variations thereof) is used in this specification in the inclusive sense of "having" or "including", and not in the exclusive sense of "consisting only of".

The above discussion of the prior art in the Background of the invention, is not an admission that any information discussed therein is citable prior art or part of the common general knowledge of persons skilled in the art in any country.

BRIEF DESCRIPTION OF INVENTION

Accordingly, in a first broad form of the invention, there is provided an explosive element; said explosive element subjected to an initial spreading against a target surface on impact of said explosive element with said target surface; said explosive element so constructed as to control the rate of spreading and compression against said surface prior to detonation.

Preferably, said explosive element includes a first and a second explosive body; said second explosive body detonating subsequent to said impact; said first explosive body subjected to secondary spreading and detonation by said detonating of said second explosive body.

Preferably, said explosive element is supported in a plastic carrier structure comprising a finned sleeve with an open forward end; said forward end forming a socket for insertion of said explosive element.

Preferably, a cap over said open forward end retains said explosive element in said socket prior to use.

Preferably, said first explosive body is contained in an elastomer fabric envelope and forms a foremost portion of said explosive element.

Preferably, said second explosive body forms a rearmost portion of said explosive element.

Preferably, said first and said second explosive bodies are held in close abutment one to another; said first and second explosive bodies assembled in a fibreboard sleeve inserted into said socket as a sliding fit.

Preferably, said first explosive body is a P.E.4 plastic explosive; said plastic explosive comprising volumes of explosive nitroamine (RDX) and oils or greases.

Preferably, said volumes of RDX and said oils or greases are 87 percent and 13 percent respectively.

Preferably, said second explosive body is a cast hexolite explosive; said hexolite comprising volumes of said RDX and of TNT.

Preferably, said volumes of RDX and TNT are 60 percent and 40 percent respectively.

Preferably, an explosive booster is located in a recess provided at a rear portion of said second explosive body.

Preferably, a detonator is inserted into said explosive booster; said detonator passing through an aperture in a base portion of said socket and in communication with a fuse retained in a fuse housing of said plastic carrier structure.

Preferably, said explosive booster is formed of P.E.4 plastic explosive.

Preferably, said explosive element and said carrier structure are discharged from a tubular cannon located at a predetermined distance from said target surface.

In another broad form of the invention, there is provided a method of fracturing rock strata; said method including the steps of impacting said rock strata with an explosive element; said explosive element including a first explosive body; said method including the steps of:

fitting said explosive element into a socket of a carrier structure, loading said explosive element and said carrier structure into a tubular cannon located at a predetermined distance from said rock strata, discharging said explosive element and carrier structure from said tubular cannon so as to impact a surface of said rock strata, wherein at least a portion of said explosive element is caused to spread over said surface prior to detonation of said explosive element.

Preferably, said explosive element includes a first and a second explosive body; said first and second explosive bodies.

Preferably, at least a portion of said first explosive body is caused to spread against said surface on impact of said explosive element with said surface.

Preferably, a fuse located in a booster explosive fires a detonator to detonate said booster explosive subsequent to said impact against said surface; detonation of said booster explosive detonating said second explosive body.

Preferably, detonation of said second explosive body causes further spreading of said first explosive body against said surface.

Preferably, said detonation of said second explosive body further causes detonation of said first explosive body.

Preferably, detonation of said first explosive body is tamped by detonation of said second explosive body.

Preferably, shock waves of detonation of said first and second explosive bodies are radiated through said rock strata; said shock waves causing pulverisation in area of said spreading and propagation of cracks within said rock strata.

In another broad form of the invention, there is provided an explosive element; said explosive element including at least one explosive body contained within an elastomeric envelope; said elastomeric envelope acting to control a rate of deformation of said at least one explosive body within microseconds after impact of said explosive body with a target surface.

Preferably, said explosive element is a rock fracturing explosive element; said at least one explosive body radiating shock waves through rock strata causing propagation of cracks and pulverisation of said strata.

BRIEF DESCRIPTION OF DRAWINGS

Embodiments of the present invention will now be described with reference to the accompanying drawings wherein.

DETAILED DESCRIPTION OF PREFERRED EMBODIMENTS

The present invention provides an explosive body for a rock-fracturing mining projectile which may be fitted to a carrier structure to form a projectile and fired at rock strata so as to pulverize and or shatter the strata in a mining operation.

The present invention may be utilised in any suitable commercially available launching system, for example the Rocktek Quickdraw system for stope clearance or any other similar system, whether propelled by pyrotechnic or compressed gas means. The present invention is also applicable to avalanche control, which utilises similar projectile launching and fusing systems to those devices utilised for stope clearance as previously disclosed in U.S. Pat. No. 6,457,416 noted above. The history of propelled explosive charges equipped with impact fuses, fins and base plates dates back at least one hundred and forty years. Examples can be found in use in the American Civil War, WW 1, WW2 and subsequently. Impact fused avalanche control projectiles are in prolific use in the snowfields of Canada, the United States, Switzerland and elsewhere.

The present invention provides a substantial improvement over existing known prior art and existing commercial systems, in that the expanding nature of the first explosive body coupled with the detonation sequencing of the second explosive body and subsequently, the first explosive body, produces enhanced rock breaking effects and most probably enhanced avalanche control effects in comparison to existing explosive systems.

First Preferred Embodiment

Figure 1:
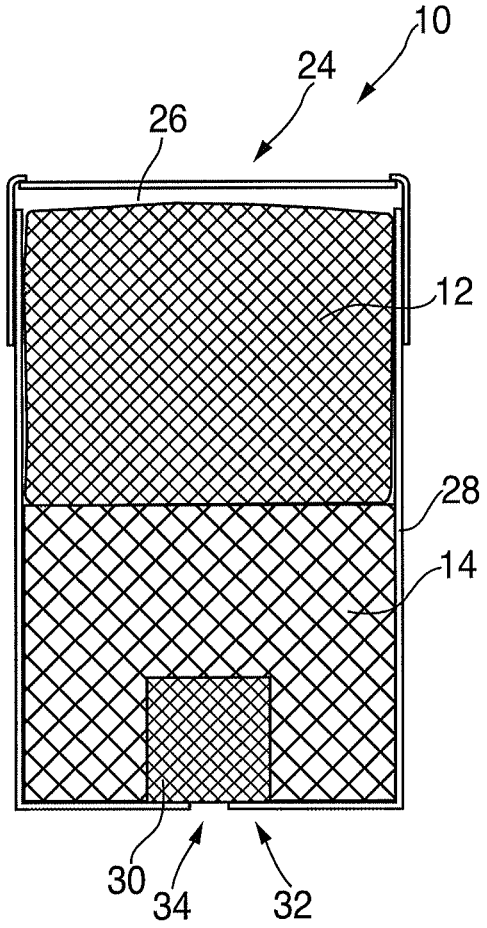
FIG. 1 is a sectioned side view of an improved rock fracturing mining explosive element including first and second explosive bodies according to a preferred embodiment of the invention.
Figure 4:
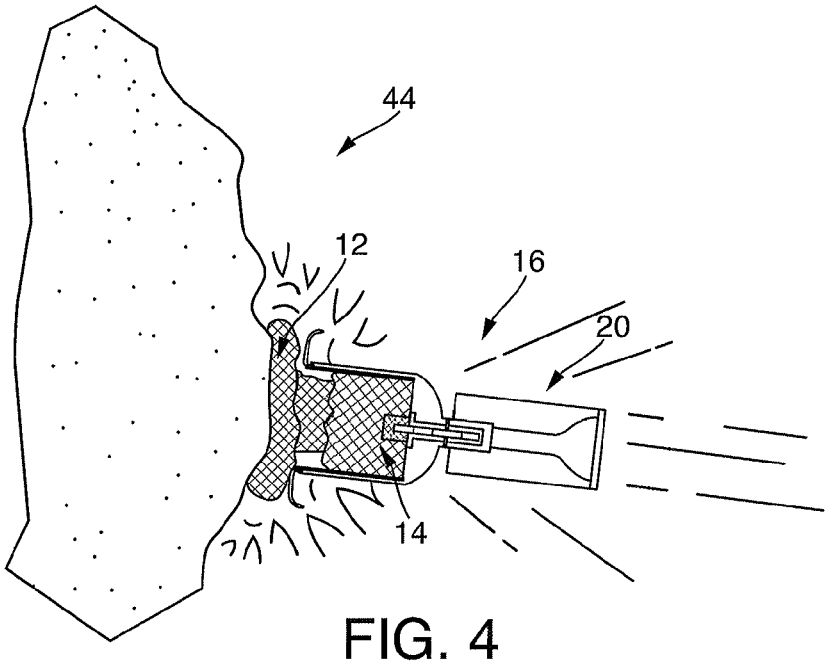
FIG. 4 is an instantaneous depiction of the explosive element and carrier structure microseconds after initial impact with rock strata.
Figure 5:
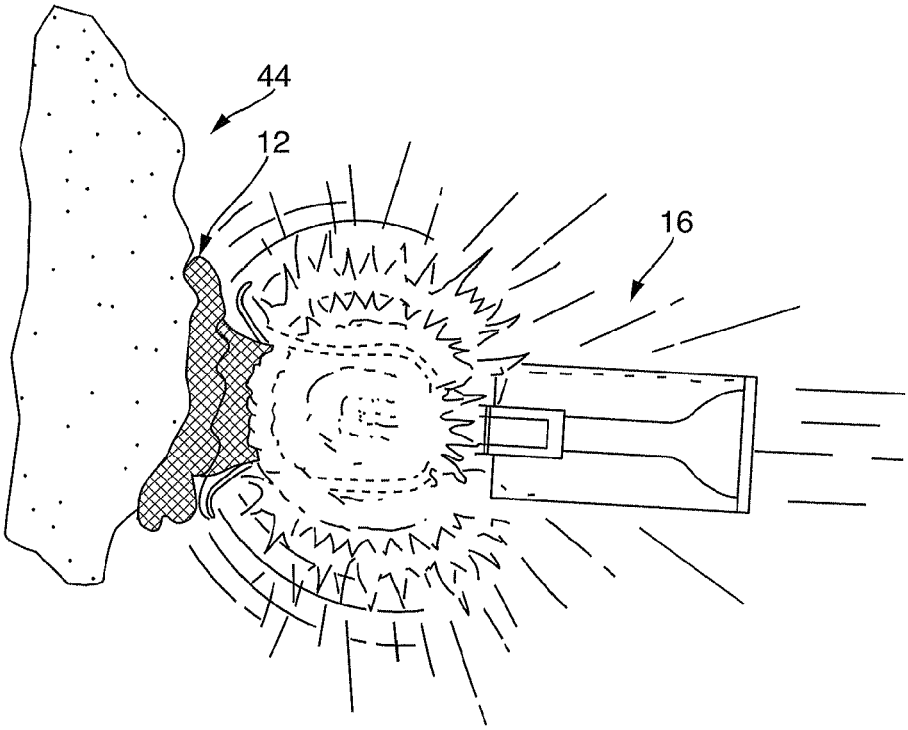
FIG. 5 is a further instantaneous depiction of the explosive element following detonation of a second explosive body of the explosive element.
Figure 6:
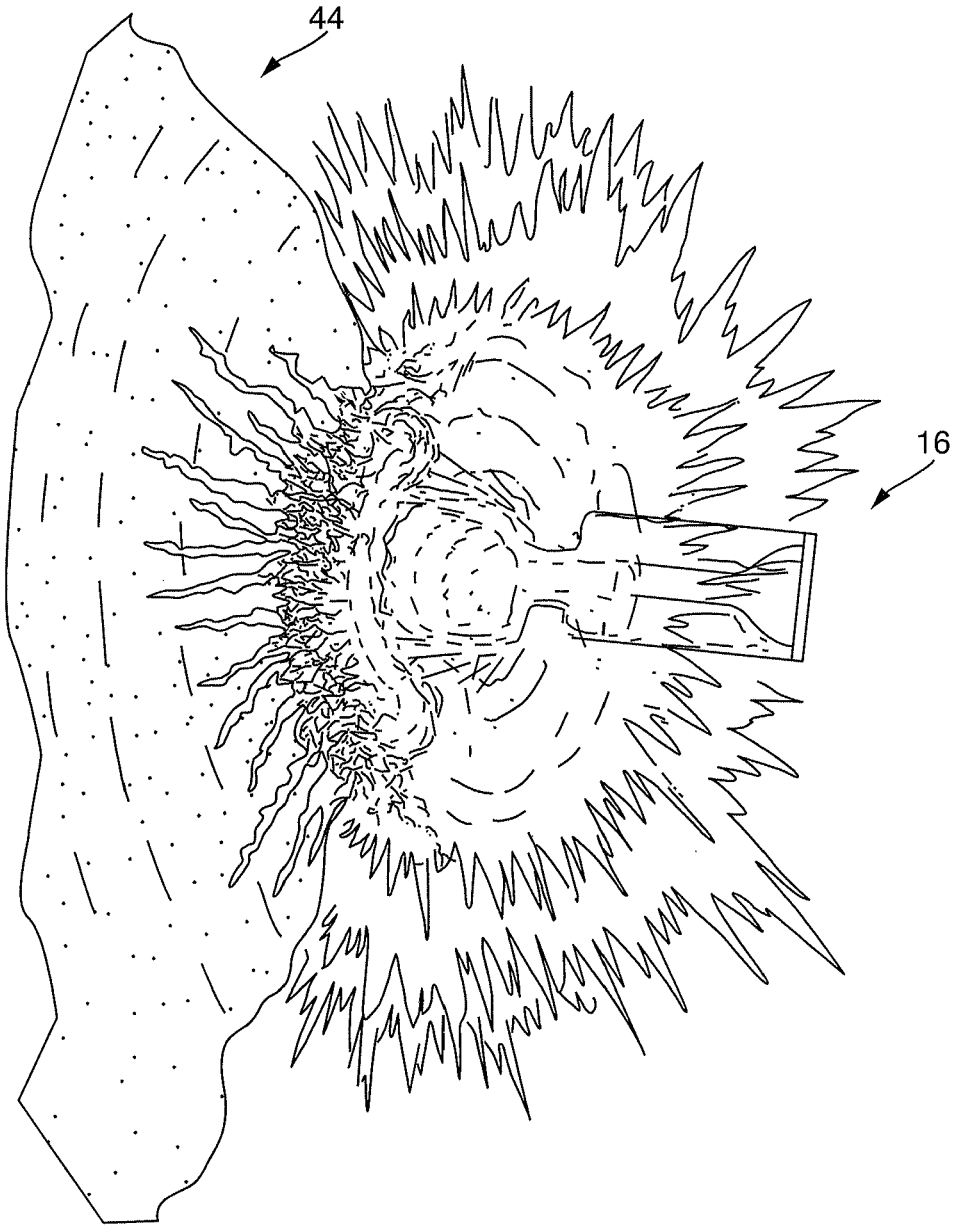
FIG. 6 is a further instantaneous depiction of the explosive element at a subsequent moment in which detonation of a first explosive body has occurred.
Figure 7:
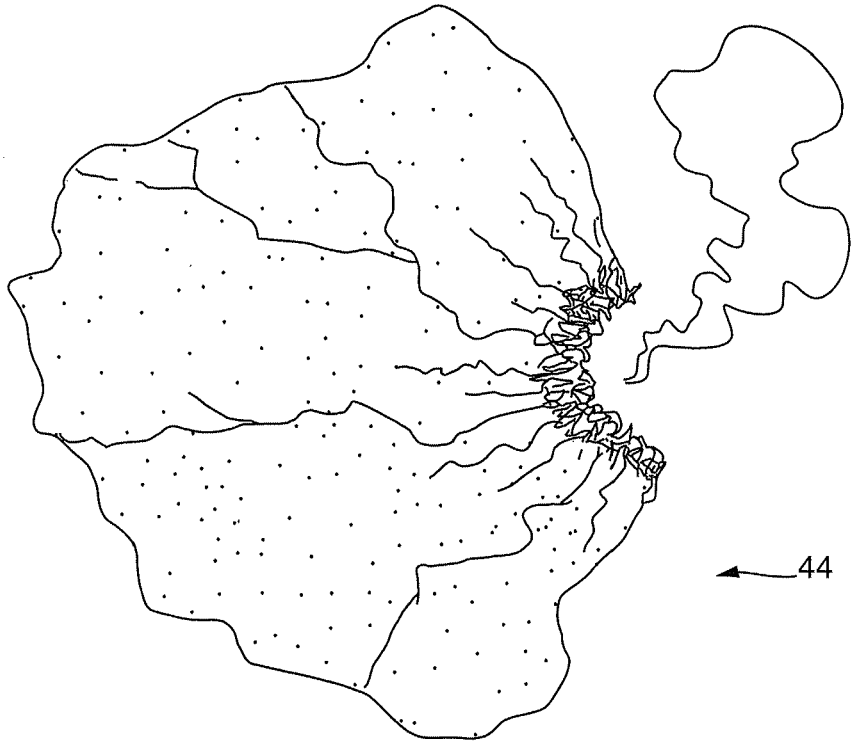
FIG. 7 is a sectioned view of rock strata illustrating the effect of the impact of the explosive element of the invention on the strata.

With reference to FIG. 1, in a preferred embodiment of an explosive element 10, it includes a first explosive body 12 and a juxtaposed second explosive body 14. In operation, as shown in the sequence of FIGS. 4 to 6, the first explosive body 12 is so constructed as to control the rate of its spreading and compression against a surface prior to detonation when subjected to an initial impact against a target, causing extremely rapid, yet progressive, annular expansion and radial squashing against the target surface, typically a rock face or boulder. The second explosive body is detonated subsequent to the impact of the explosive element, causing a virtually instantaneous secondary spreading and explosive tamping of the first expanding explosive body against the surface. In addition to the virtually instantaneous secondary spreading and explosive tamping, explosion of the second explosive body causes detonation of the first explosive body.

Figure 2:
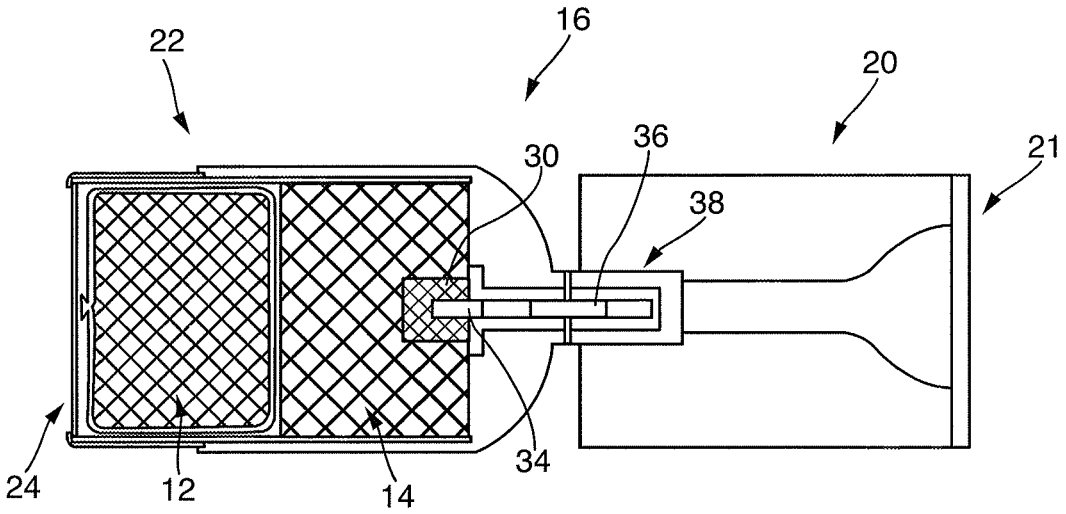
FIG. 2 is a sectioned side view of the explosive element of FIG. 1 fitted to a carrier structure.

Referring again to FIG. 1 and now also to FIG. 2, the explosive element 10 is supported in a plastic carrier structure 16 comprising a forward sleeve or socket portion 18 and a finned rear portion 20. The rear of the finned portion is provided with a base plate 21.

The sleeve portion 18 is open at its forward end 22, with the forward end accepting insertion of the explosive element 10. A cap 24 over the open forward end retains the explosive element 10 in the socket prior to use.

The first explosive body may be formed of a malleable explosive mass, the consistency of which is such as to deform and spread in a controlled manner in the first microseconds of impact with a surface. Alternatively, the first explosive body 12 may consist of a prilled or powdered or gelled or emulsified explosive contained in an elastomer fabric envelope 26 so that the elastomer envelope provides the desired controlled deformation and spreading. In either case, the first explosive body is located in a foremost portion of the socket, while the second explosive body 14 locates in a rearmost portion of the socket.

The first and second explosive bodies 12 and 14, are held in close abutment one to another, with the first and second explosive bodies assembled in a fibreboard sleeve 28, closed at its rearward end and inserted into the socket portion 18 as a sliding fit.

The first explosive body comprises a P.E.4 plastic explosive formed of volumes of explosive nitroamine (RDX) and oils or greases. Preferably, the volumes of RDX and the oils or greases are in the proportions of 87 to 88 percent and 12 to 13 percent respectively.

The second explosive body comprises a cast hexolite explosive made up of volumes of RDX and of TNT. Preferably, the volumes of RDX and TNT are 60 percent and 40 percent respectively. One percent beeswax by volume is also normally present.

An explosive booster 30 formed of P.E.4 plastic explosive, is located in a recess 32 provided at the rear of the second explosive body 14. A detonator 34 is inserted into this explosive booster 30 and extends rearwardly through an aperture 34 in the closed base of the fibreboard sleeve 28 and through the base portion of the socket 18. Detonator 34 is in communication with a fuse 36 retained in a fuse housing 38 of the plastic carrier structure 16.

IN USE

In use, the explosive element 10 is fitted with a fuse 34 and loaded into the carrier structure 16, previously prepared with detonator 36. The explosive element is sealed in the carrier structure with end cap 24.

Figure 3:
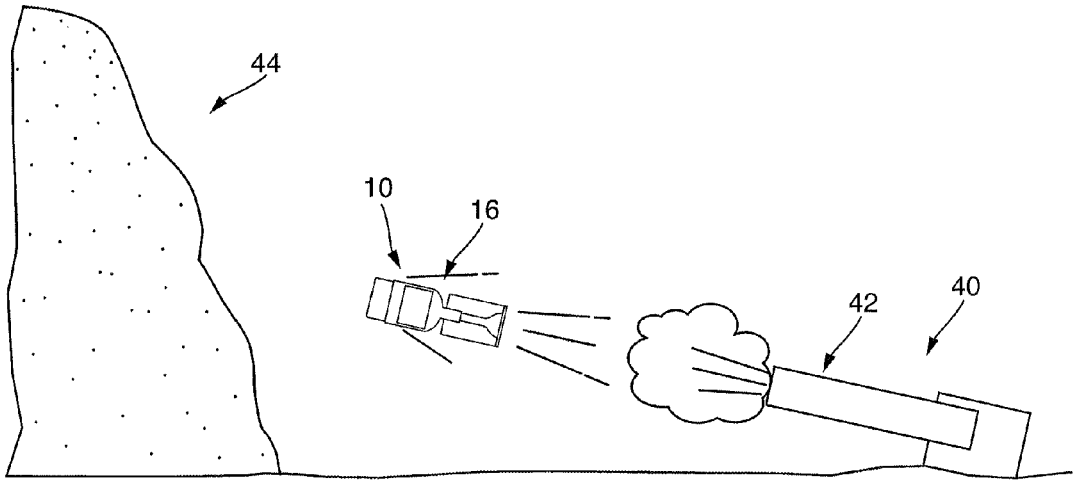
FIG. 3 is a view of a method of applying the explosive element and carrier structure to rock strata.

The explosive element and its carrier structure are then loaded into a launching structure 40, shown in FIG. 3.

Launching structure 40 may comprise for example a tubular cannon 42 suitably supported at a predetermined distance from rock strata 44. A charge provided in the rear end of cannon 42 acts against base plate 21 to eject the explosive element and carrier structure from the cannon.

As shown in FIG. 4, the first explosive body 12 bursts through end cap 24 and is caused to spread against the rock strata surface on impact. The impact causes the fuse 36 to fire the detonator 34 which in turn detonates the P.E.4 booster 30. Detonation of the booster causes the explosion of the second explosive body 14 which initially acts virtually instantaneously to squash and further spread the first expanding explosive body over the surface of the rock strata. Microseconds later the explosion of the second explosive body causes the first explosive body, now spread out and in intimate close contact with the surface, to also explode. In addition, the explosion of the second explosive body acts as an effective tamping enhancing the effect of the explosion force of the first explosive body.

The rock immediately under the region of the squashed first explosive body is totally pulverized. Cracks are propagated trough the strata and pulverized rock is jetted hypersonically into and expands micro fractures. Shock waves travel though the strata and, in the case of a boulder refract back from free faces causing a further propagation of cracks to the extent that a boulder may be totally compromised and fall to pieces.

The special structure of the explosive element of the invention, the selection of its explosive components and the manner in which the sequence of spreading and detonation proceeds from impact, provides an effective and improved tool for use in mining operations.

It will be understood that while primarily intended for mining, the advantages offered by the explosive element of the present invention may also be beneficial in a variety of other applications. These may include for example, emergency demolition of unstable buildings, controlled triggering of potential avalanches, forced entry by law enforcement agencies into fortified buildings, as well as military uses.

Second Preferred Embodiment

Figure 8:
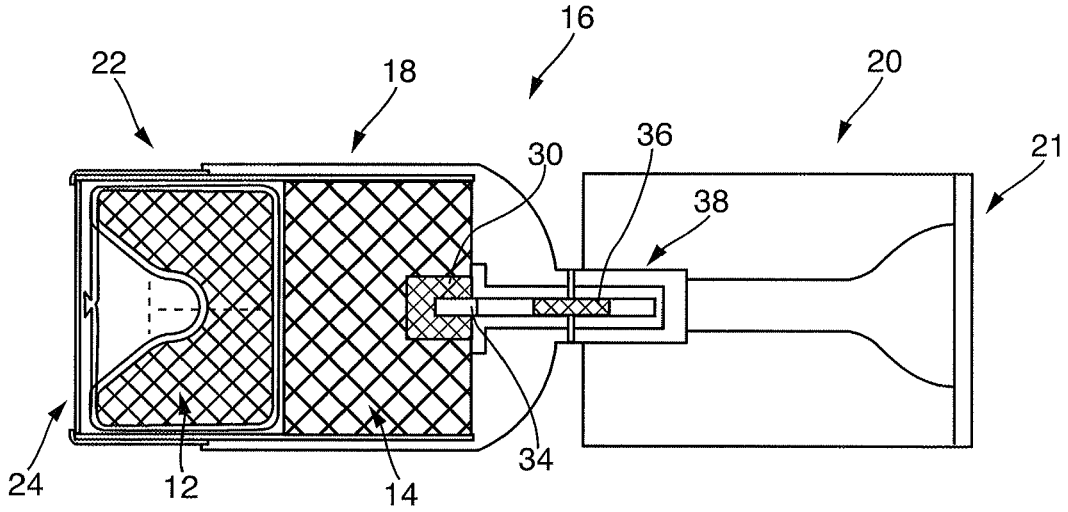
FIG. 8 is a sectioned view of an explosive element and carrier structure according to a further embodiment of the present invention.
Figure 9:
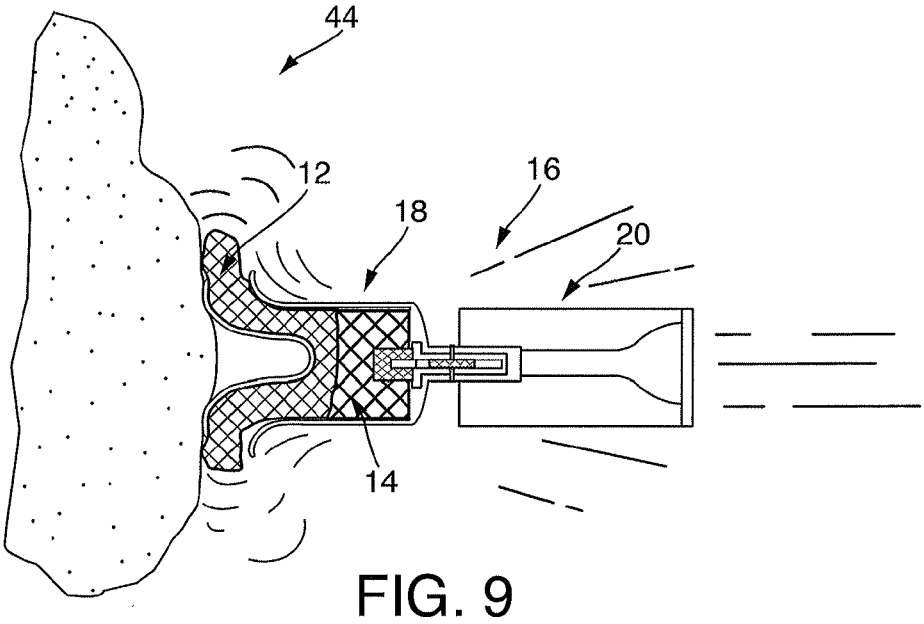
FIG. 9 is a sectioned view of the behaviour of the explosive element of FIG. 8 on initial impact and FIG. 10 is a sectioned view of the nature of the penetration of a blast wave arising from use of the explosive element of FIG. 8.
Figure 10:
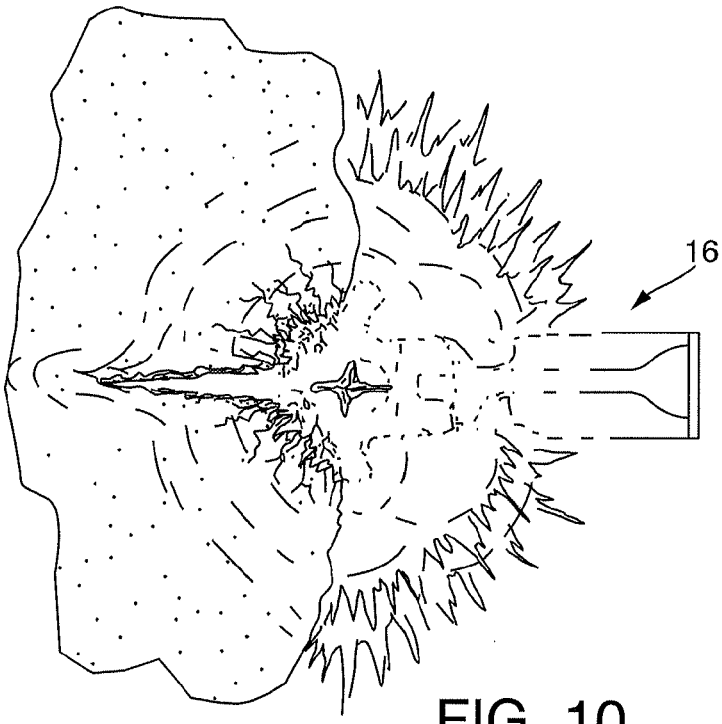

With reference to FIGS. 8, 9 and 10 there is illustrated an alternative arrangement wherein like components are numbered as for the first embodiment above.

In this instance the first explosive body 12 is shaped so as to have an indented portion 50 in a leading surface thereof defined by a flexible elastomeric frustoconical skirt 51 together with a centralised metallic shaped charge liner 52.

With this arrangement, as impact occurs with rock or like strata 44, the skirt 51 splits and spreads out against the strata 44 as illustrated in FIG. 9 prior to detonation. As illustrated in FIG. 10 the detonation sequence follows as for the previously described embodiment and, in this case, the shaped charge liner deforms and a jet formed by the metallic liner 52 penetrates the target thereby enhancing the effect previously described.

Other Preferred Embodiments

The explosive formulations described for the first preferred embodiment above may be substituted for other explosives formulations well known in the industry. For example the first explosive body as described may be also a prilled explosive, a powder explosive, a gelled explosive or any other explosive that suitably expands on impact, with or without a containing elastomer enclosure as described. The second explosive may also be any cast or relatively stiff explosive. Examples of cast explosive for the second explosive body are, pentolit, TNT, Octol or any other cast composition known in the art. Examples of a relatively stiff explosive include Polyurethane/RDX mixtures, Hydroxyl Terminated Polybutadiene (HTPB)/RDX mixtures and other polymer bonded explosive formulations well known in the art. Alternatively, it may be desirable for the explosive component to be entirely composed of a single squashable explosive composition without the addition of a second explosive body as described in the preferred embodiment above. A booster may also not be necessary depending on the sensitivity of the explosive composition. For example if the second explosive body is Pentolite (60/40 or 50/50 PETN/TNT) a booster is not required, as this composition is detonator sensitive, whereas Hexolite described for the preferred embodiment above, is not and requires a booster. The booster in any case may also be of a variety of explosive materials well known in the art.

In another preferred arrangement, the explosive forming the explosive element may be a container of a single explosive material, spreadable on impact with a surface, so constructed as to control the rate of spreading and compression against the surface prior to detonation.

In this arrangement, the explosive element is contained in an elastomeric bag or envelope of sufficient strength to control the rate of deformation of the explosive element in the microseconds after impact. The strength of this envelope can be matched to the explosive material used Thus a prilled explosive material would require the elastomeric envelope to provide all the control of deformation, whereas a malleable explosive would require significantly less strength.

The above describes only some embodiments of the present invention and modifications, obvious to those skilled in the art, can be made thereto without departing from the scope of the present invention.

The invention claimed is:

1. An explosive element; said explosive element subjected to an initial spreading against a target surface on impact of said explosive element with said target surface; said explosive element so constructed as to control the rate of spreading and compression against said surface prior to detonation; and wherein said explosive element includes a first and a second explosive body; said second explosive body detonating subsequent to said impact; said first explosive body subjected to secondary spreading and detonation by said detonating of said second explosive body.

2. The explosive element of claim 1, wherein said explosive element is supported in a plastic carrier structure comprising a finned sleeve with an open forward end; said forward end forming a socket for insertion of said explosive element.

3. The explosive element of claim 2, wherein a cap over said open forward end retains said explosive element in said socket prior to use.

4. The explosive element of claim 2, wherein said first and said second explosive bodies are held in close abutment one to another; said first and second explosive bodies assembled in a fibreboard sleeve inserted into said socket as a sliding fit.

5. The explosive element of claim 1, wherein said first explosive body is contained in an elastomer fabric envelope and forms a foremost portion of said explosive element.

6. The explosive element of claim 1, wherein said second explosive body forms a rearmost portion of said explosive element.

7. The explosive element of claim 1, wherein said first explosive body is a P.E.4 plastic explosive; said plastic explosive comprising volumes of explosive nitroamine (RDX) and oils or greases.

8. The explosive element of claim 7, wherein said volumes of RDX and said oils or greases are 87 percent and 13 percent respectively.

9. The explosive element of claim 1, wherein said second explosive body is a cast hexolite explosive; said hexolite comprising volumes of said RDX and of TNT.

10. The explosive element of claim 9, wherein said volumes of RDX and TNT are 60 percent and 40 percent respectively.

11. The explosive element of claim 1, wherein an explosive booster is located in a recess provided at a rear portion of said second explosive body.

12. The explosive element of claim 11, wherein a detonator is inserted into said explosive booster; said detonator passing through an aperture in a base portion of said socket and in communication with a fuse retained in a fuse housing of said plastic carrier structure.

13. The explosive element of claim 11, wherein said explosive booster is formed of P.E.4 plastic explosive.

14. The explosive element of claim 1, wherein said explosive element and said carrier structure are discharged from a tubular cannon located at a predetermined distance from said target surface.

15. An explosive element;

said explosive element including a first and a second explosive body contained within an elastomeric envelope;

said elastomeric envelope acting to control a rate of deformation of said explosive element within microseconds after impact of said explosive body with a target surface; said explosive element subjected to an initial spreading against a target surface on impact of said explosive element with said target surface; said explosive element so constructed as to control the rate of spreading and compression against said surface prior to detonation; and wherein said explosive element includes said first and said second explosive body; said second explosive body detonating subsequent to said impact; said first explosive body subjected to secondary spreading and detonation by said detonating of said second explosive body.

16. The explosive element of claim 15, wherein said explosive element is a rock fracturing explosive element; said at least one explosive body radiating shock waves through rock strata causing propagation of cracks and pulverisation of said strata.

* * * * *

UNITED STATES PATENT AND TRADEMARK OFFICE

CERTIFICATE OF CORRECTION

PATENT NO. : 9,291,439 B2
APPLICATION NO. : 13/537931
DATED : March 22, 2016
INVENTOR(S) : Chris Murray et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 343 days.

Signed and Sealed this
Fourteenth Day of June, 2016

Michelle K. Lee

Michelle K. Lee
*Director of the United States Patent and Trademark Office*